US005455982A

United States Patent [19]

Armstrong et al.

[11] Patent Number: 5,455,982

[45] Date of Patent: Oct. 10, 1995

[54] HARD AND SOFT FLOOR SURFACE CLEANING APPARATUS

[75] Inventors: Cary W. Armstrong, Robbinsdale; Patrick A. Huttner, Deephaven; Everett E. Johnson, Waconia, all of Minn.

[73] Assignee: Advance Machine Company, Plymouth, Minn.

[21] Appl. No.: 231,395

[22] Filed: Apr. 22, 1994

[51] Int. Cl.[6] ..... A47L 11/282; A47L 11/29; A47L 11/30

[52] U.S. Cl. ..... 15/320; 15/328; 15/338; 15/414

[58] Field of Search ..... 15/328, 338, 320, 15/354, 359, 414, 353

[56] References Cited

U.S. PATENT DOCUMENTS

| | | | |
|---|---|---|---|
| 3,559,230 | 2/1971 | Ogle | 15/354 |
| 4,006,506 | 2/1977 | Burgoon | 15/320 |
| 4,369,544 | 1/1983 | Parisi | 15/320 |
| 4,819,676 | 4/1989 | Blehert et al. | 15/353 |
| 4,956,891 | 9/1990 | Wulff | 15/320 |
| 5,093,955 | 3/1992 | Blehert et al. | 15/328 |
| 5,319,828 | 6/1994 | Waldhauser et al. | 15/320 |

OTHER PUBLICATIONS

Convertamatic Models 32 B, 32BD, 38 BD, Parts List 042 059, Ser. No. 878 509, rev. mar. 1982 Advance Machine Company, Spring Park, Minn. 55384 USA.

Convertamatic Model 260B, Parts List for machines after Ser. No. 776 159, © Advance Machine Co. Advance Machine Company, Spring Park, Minn. 55384–0275.

Convertamatic Model 21B, Parts List for machines after Ser. No. 059 180, ©1985 Advance Machine Co. Advance Machine Company, Spring Park, Minn. 55384–0275.

Aquaclean Model 262500, Parts List for machines after Ser. No. 359336,© 1989 Advance Machine Co. Advance Machine Company, Plymouth Minn.8 55447–3408.

*Primary Examiner*—Timothy F. Simone
*Assistant Examiner*—Reginald L. Alexander
*Attorney, Agent, or Firm*—Peterson, Wicks, Nemer & Kamrath

[57] ABSTRACT

Apparatus (10) is disclosed including an interchangeable brush (88) and either a removable vacuum shoe (38) for soft floor surfaces or removable squeegee and carriage assemblies (56, 68) for hard floor surfaces. A spindle (32) is rotatably mounted in the chassis (18) and includes first and second arms (36, 52). The first arm (36) is attached to a sleeve (34) for removably and pivotally receiving a pivot pin (40) of the vacuum shoe (38). The second arm (52) includes an elongated slot (54) which slideably receives a follower pin (82) of a crank arm (80) of the carriage assembly (68). The spindle (32) is rotated by an integral lever (44) pivotally connected to a linkage (46) having its opposite end pivotally connected to a second, pivotable lever (26). A bracket (20) is pivotable with a handle (16) and abuts with the second lever (26) to support the chassis (18) by the vacuum shoe (38) or the roller (86) of the carriage assembly (68) such that the brush (88) is spaced from the floor surface when the handle (16) is in a transport position. The free end of a screw (30) threadably secured in the chassis (18) abuts with the second lever (26) when the handle (16) is in operating positions to adjust the height of the brush (88) relative to the floor surface.

21 Claims, 2 Drawing Sheets

HARD AND SOFT FLOOR SURFACE CLEANING APPARATUS

BACKGROUND

The present invention generally relates to apparatus for cleaning floors, particularly to floor cleaning apparatus which applies cleaning solutions to the floor and then vacuums the soiled cleaning solutions from the floor, and specifically to floor cleaning apparatus which applies and vacuums cleaning solutions from either hard or soft floor surfaces.

Many buildings have both hard and soft floor surfaces such as tile floors in high traffic and/or work areas and carpet in office and/or business areas. Apparatus for maintaining hard and soft floor surfaces are of differing types and prior to the present invention, separate apparatus were required. If the size of the area of any particular type of floor surface did not Justify the capital costs for apparatus utilized for maintaining the particular type of floor surface, that floor surface type was often cleaned manually, sporadically, or not at all. Likewise, other factors such as lack of storage space prevented purchase and/or use of separate apparatus for hard and soft floor surfaces.

Thus, a need exists for an apparatus which can be utilized on both hard and soft floor surfaces such that separate apparatus are not required. Additionally, such an apparatus should be operable in either mode substantially in the same manner of operation as prior separate apparatus. Further, such an apparatus should be easily converted between different modes of use and result in substantial cost savings over having both, separate types of floor surface cleaning apparatus.

SUMMARY

The present invention solves this need and other problems in the field of cleaning floor surfaces by providing, in the preferred form, an apparatus for cleaning both hard and soft floor surfaces including a chassis having a first end movably supported on the floor surface and having a brush adjacent to the second end for engagement with the floor surface. A vacuum shoe of a generally rigid construction for extraction of solution from soft floor surfaces, a carriage assembly, and a squeegee assembly for removing solution from hard floor surfaces are each removably secured adjacent the second end of the chassis. One of the vacuum shoe and the carriage assembly is moved for supporting the second end of the chassis to change the relative height of the brush from the floor surface.

It is thus an object of the present invention to provide a novel apparatus for cleaning floor surfaces.

It is further an object of the present invention to provide such a novel floor surface cleaning apparatus which applies cleaning solutions to the floor surface and then picks up the soiled cleaning solutions from the floor surface.

It is further an object of the present invention to provide such a novel floor surface cleaning apparatus usable for either hard or soft floor surfaces.

It is further an object of the present invention to provide such a novel floor surface cleaning apparatus which is easily transformable and converted between different modes of operation for hard and soft floor surfaces.

It is further an object of the present invention to provide such a novel floor surface cleaning apparatus resulting in substantial savings over separate apparatus for hard and soft floor surfaces.

It is further an object of the present invention to provide such a novel floor surface cleaning apparatus which is of a simple mechanical design.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
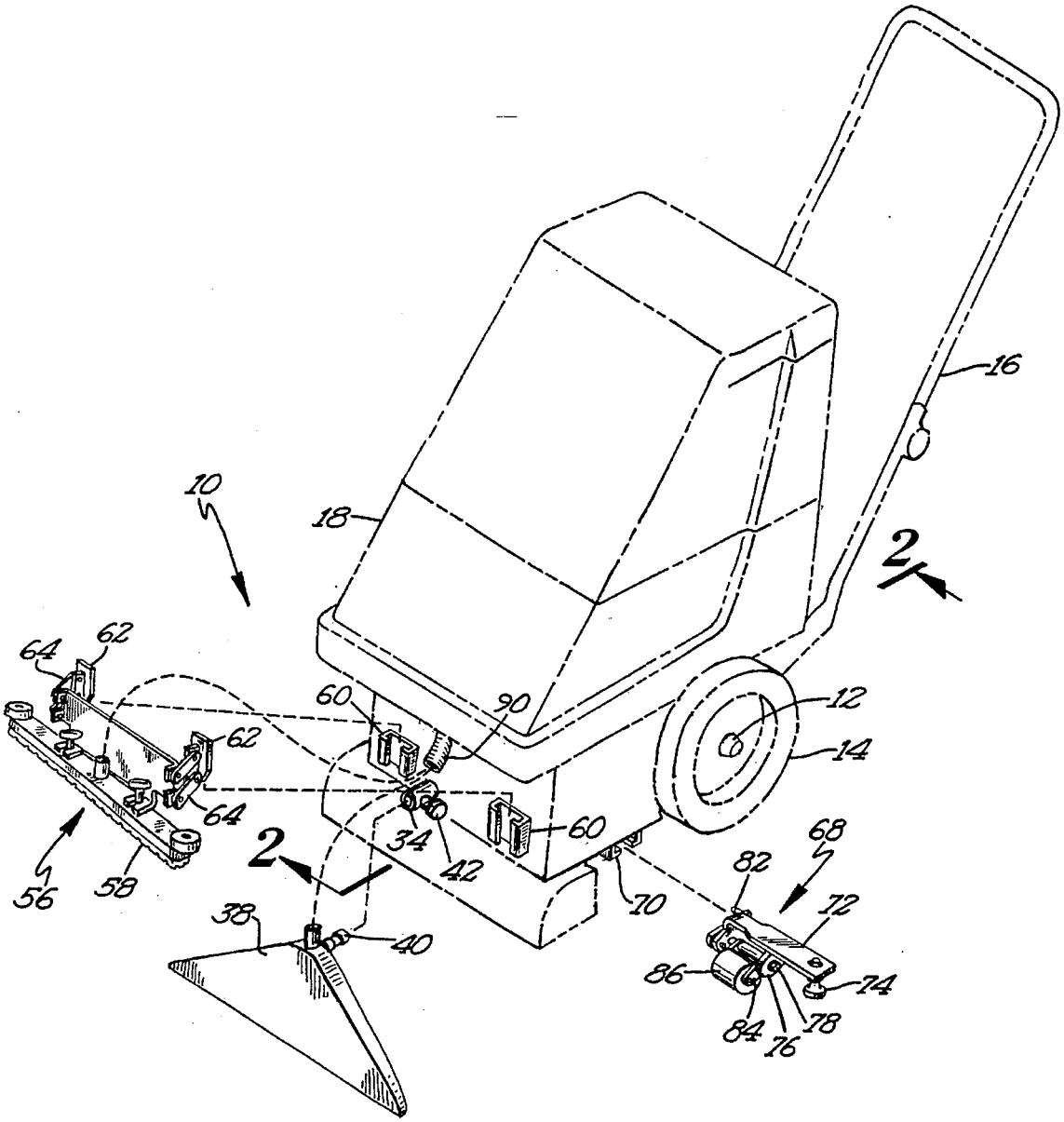
FIG. 1 shows a perspective view of an apparatus for cleaning either hard or soft floor surfaces according to the preferred teachings of the present invention, with portions shown in phantom.
Figure 2:
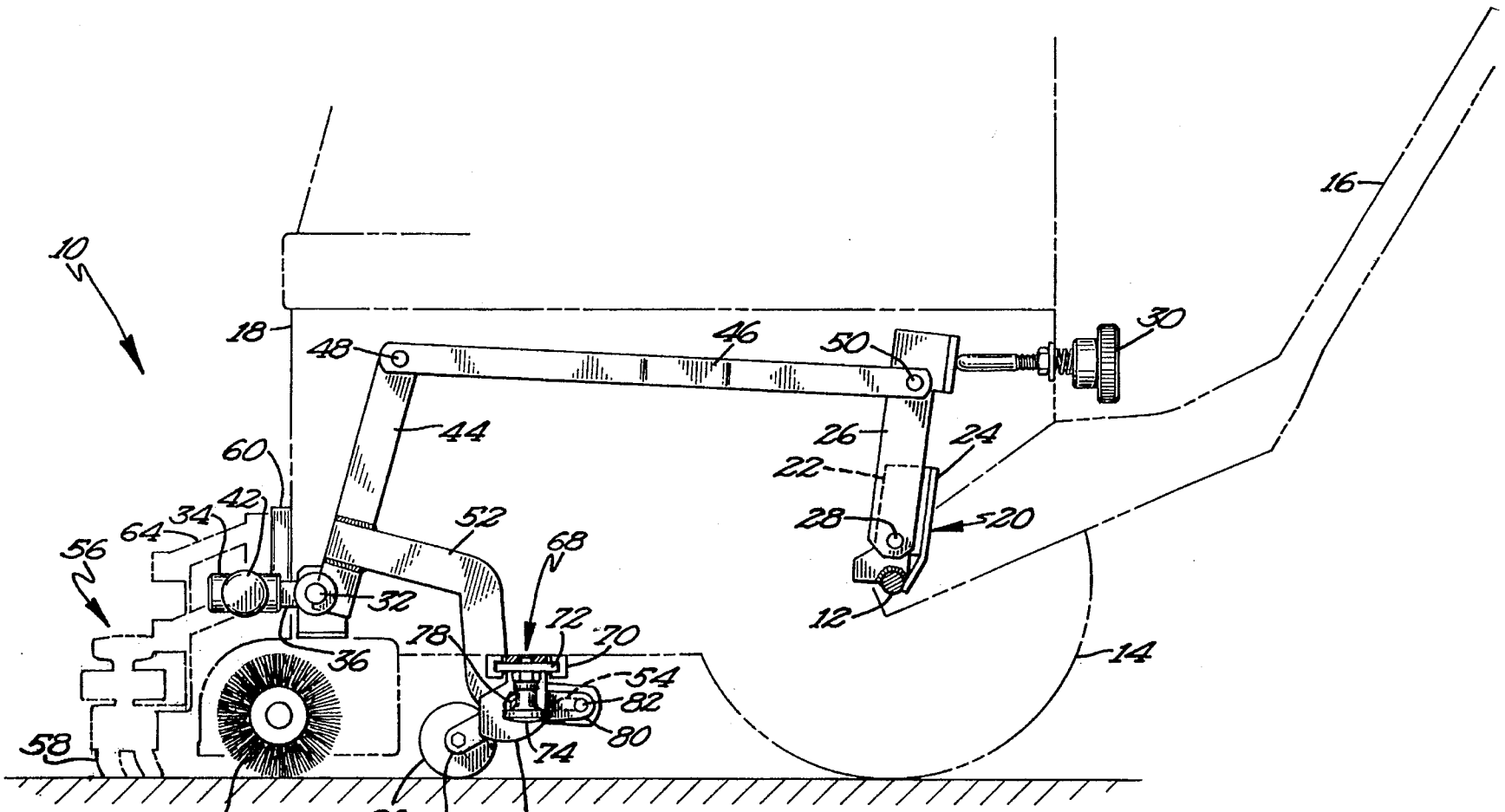
FIG. 2 shows a cross-sectional view of the apparatus of FIG. 1 according to section line 2—2 of FIG. 1, with portions being omitted to show constructional details.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "front", "back", "upper", "lower", "height", "width", "length", "end", "side", "horizontal", "vertical", "axial", "radial", and similar terms are used herein, it should be understood that these terms have reference only to the structure shown in the drawings as it would appear to a person viewing the drawings and are utilized only to facilitate describing the invention.

DESCRIPTION

Apparatus for cleaning floor surfaces and for applying a cleaning solution to a floor surface and for extracting the soiled solution from the floor surface is shown in the drawings and generally designated 10. Generally, apparatus 10 includes an axle 12 upon which suitable first and second wheels 14 are rotatably mounted on opposite ends thereof for movably supporting the first end of the chassis 18 of apparatus 10 on the floor surface. Integrally secured to axle 12 intermediate wheels 14 is a U-shaped handle 16. Axle 12 is rotatably mounted to chassis 18 of apparatus 10 allowing handle 16 to be pivoted about a handle axis defined by axle 12 between a transport position and one of a plurality of working positions according to the height and other attributes of the particular operator of apparatus 10. A generally L-shaped bracket 20 is further integrally secured to axle 12 intermediate wheels 14 and specifically includes a first plate 22 integrally secured to and extending perpendicular from axle 12 and a second plate 24 extending generally perpendicular to first plate 22 and parallel to and spaced from axle 12. A lever 26 is pivotally mounted to plate 22 about an axis 28 parallel to but spaced from axle 12 and abuts with second plate 24.

Apparatus 10 further includes an adjustment screw 30 mounted in chassis 18 for axial movement and having a free end which abuts with lever 26 adjacent to its free end and spaced from axis 28. Screw 30 is generally positioned in a horizontal plane spaced above axle 12 and extends generally parallel to the movement direction of apparatus 10 and perpendicular to axle 12. Screw 30 is adjustable such as by threading such that the position of its free end abutting with lever 26 allows lever 26 to be in differing pivotable positions on axis 28 and relative to bracket 20.

Apparatus 10 according to the preferred teachings of the present invention includes a spindle 32 pivotally mounted to chassis 18 parallel to and spaced from axle 12 and axis 28 and adjacent the opposite end of chassis 18 than handle 16. An attachment sleeve 34 is attached to spindle 32 by an arm 36, with the attachment sleeve 34 positioned outside of chassis 18 generally perpendicular to but spaced from spindle 32. Apparatus 10 further includes a vacuum shoe 38 such as of the type utilized to extract soiled solution from soft floor surfaces such as carpet, with shoe 38 being of a generally rigid construction of a triangular shape. Shoe 38 includes a pivot pin 40 of a size for slideable and rotatable receipt in sleeve 34. Suitable interlocking provisions 42 are provided to allow axial insertion and removal of pivot pin 40 into sleeve 34 and to prevent axial movement of pivot pin 40 from sleeve 34 while allowing rotatable movement of pivot pin 40 within sleeve 34. In the most preferred form, provisions 42 are shown as a plunger pin radially slideable relative to sleeve 34 and having a free end which is received in a circumferential groove formed in pivot pin 40. Thus, sleeve 34, pivot pin 40 and provisions 42 removably secure vacuum shoe 38 relative to chassis 18 adjacent the end of chassis 18 opposite handle 16.

A lever 44 is integrally secured to spindle 32 and extends generally perpendicular thereto and to sleeve 34. The first end of a linkage 46 is pivotally mounted to the free end of lever 44 about an axis 48 generally parallel to and spaced from spindle 32. The opposite end of linkage 46 is pivotally mounted to the free end of lever 26 about an axis 50 generally parallel to and spaced from axle 12 and axis 28. A generally Z-shaped arm 52 has a first end integrally secured to lever 44 intermediate spindle 32 and axis 48. Arm 52 generally includes a first portion extending from lever 44 generally horizontally towards handle 16 terminating in a second generally vertical portion extending downward towards the floor surface in turn terminating in a third portion extending generally horizontally towards handle 16 and spaced vertically below chassis 18. An elongated, generally horizontal slot 54 is formed in the third portion of arm 52.

Apparatus 10 according to the preferred teachings of the present invention further includes a removable squeegee assembly 56. In the most preferred form, assembly 56 includes a suitable suction squeegee 58 such as of the type utilized to extract soiled solution from a hard floor surface such as but not limited to hardwood, tile, or cement and specifically has sufficient flexibility to conform to the hard floor surface to insure an acceptable solution pickup. First and second, vertical slide tracks 60 are mounted to chassis 18 on the opposite sides of sleeve 34. First and second slide plates 62 are vertically slideably received in tracks 60 respectively to an attachment position. First and second parallelogram linkages 64 extend between first and second slide plates 62 and squeegee 58 and have linkage axes which are parallel to spindle 32 and axle 12 and to squeegee 58. In the most preferred form, linkages 64 permit squeegee 58 to move in a direction perpendicular to the floor surface to adjust itself when moving over irregular floor surfaces and can include suitable means such as a spring for biasing squeegee 58 against the floor surface. Thus, squeegee assembly 56 is removably secured to the end of chassis 18 opposite handle 16 by slide tracks 60 and slide plates 62.

Apparatus 10 according to the preferred teachings of the present invention further includes a removable carriage assembly 68. Specifically, a slide track 70 is mounted to the underside of chassis 18 adjacent to the third portion of arm 52 including slot 54. A slide plate 72 is horizontally slideably received in track 70 in a slide direction parallel to spindle 32 to an attachment position. In the preferred form, suitable provisions 74 are provided to lock slide plate 72 in the attachment position shown in the most preferred form as a plunger pin vertically slideably mounted to slide plate 72 and having a free end which is slideably received in a bore formed in slide track 70 and/or chassis 18. First and second ears 76 integrally extend vertically downward from slide plate 72 in a spaced, parallel relation. A pivot shaft 78 is rotatably mounted to and between ears 76 about a horizontal axis parallel to the slide direction of slide plate 72. The inner end of shaft 78 includes an integral crank arm 80 extending generally perpendicular thereto. Crank arm 80 includes a follower pin 82 extending generally perpendicular therefrom at a spaced, parallel relation to shaft 78, with follower pin 82 being of a size for slideable receipt within slot 54 to operatively connect crank arm 80 to arm 52. Shaft 78 further includes mounting tabs 84 integrally extending generally perpendicular to shaft 78 at a spaced, parallel relation. A roller 86 is rotatably mounted to and between tabs 84 about a horizontal axis spaced and parallel to shaft 78. Thus, carriage assembly 68 is removably secured to chassis 18 adjacent the end opposite handle 16 by slide track 70, slide plate 72, and provisions 74.

Apparatus 10 according to the preferred teachings of the present invention generally includes a cylindrical brush 88 for engagement with the floor surface and which is driven by any suitable means and located on the end of chassis 18 opposite handle 16. Brush 88 in the preferred form includes suitable provisions as are well known in the art to allow ease of removal and replacement and in the most preferred form to allow replacement of a brush 88 designed for use in cleaning carpet or similar soft floor surfaces with a brush 88 designed for use in cleaning hardwood, tile, cement or similar hard floor surfaces or vice versa. Apparatus 10 further includes a hose 90 for removable securement to either vacuum shoe 38 or squeegee 58 and in fluid communication with a storage tank. The storage tank is placed under vacuum by a fan powered by a suitable motor to draw air from the storage tank. Apparatus 10 further includes a supply tank including suitable means such as a pump for drawing cleaning solution from the supply tank and applying it to the floor surface. In the most preferred form, a valve is provided in the cleaning solution delivery line allowing the flow of cleaning solution at a first rate for carpet or similar soft floor surface or a flow of cleaning solution at a reduced rate for hard floor surfaces or the like which do not have a tendency to absorb the cleaning solution. The cleaning solution is applied to the floor surface on the opposite side of brush 88 than vacuum shoe 38 or squeegee 58.

Now that the basic construction of apparatus 10 according to the preferred teachings of the present invention has been explained, the operation and advantages of apparatus 10 according to the preferred teachings of the present invention can be set forth and appreciated. Generally, the operation of apparatus 10 is often accomplished by pulling apparatus 10 a short distance over the floor surface while in a cleaning mode, i.e. with solution being applied to the floor surface, and brush 88 and vacuum shoe 38 or squeegee 58 engaging the floor, tilting apparatus 10 such that brush 88 and vacuum shoe 38 or squeegee 58 are spaced from the floor surface, then moving apparatus 10 forward a short distance over the same area or an adjacent area while the application of solution to the floor surface has been stopped, and tilting apparatus 10 such that brush 88 and vacuum shoe 38 or squeegee 58 again engages the floor surface and apparatus 10 is again utilized in a cleaning mode.

Prior to the present invention, separate apparatus were required for cleaning soft or hard floor surfaces. Apparatus 10 according to the preferred teachings of the present invention can then be transformed to operate on both soft and hard floor surfaces. Thus, substantial capital costs can be saved as a single apparatus 10 can be utilized where two apparatus were previously required. Specifically, assuming for the sake of example that vacuum shoe 38, squeegee assembly 56, and carriage assembly 68 are all removed from apparatus 10 and apparatus 10 is desired to be operated to clean soft floor surfaces such as carpet, vacuum shoe 38 can be installed on apparatus 10 by sliding pivot pin 40 into sleeve 34, with provisions 42 being suitably manipulated to allow insertion of pivot pin 40 into sleeve 34 and to hold pivot pin 40 and vacuum shoe 38 in an attached, operative position. Hose 90 can then be attached to vacuum shoe 38 and the valve in the solution delivery line can be positioned at the flow rate for soft floor surfaces. Brush 88 can be removed and replaced with one for use in cleaning carpet or similar soft floor surfaces if desired or necessary. In the transport or storage position of handle 16, bracket 20 will pivot lever 26 about axis 28 such that vacuum shoe 38 is in a lowermost position due to the interconnection of lever 44 and linkage 46. Due to the rigid nature of vacuum shoe 38, apparatus 10 can be supported on the floor surface at one end by wheels 14 and the opposite end by vacuum shoe 38 with brush 88 at a height spaced from the floor surface. When it is desired to clean the floor surface, handle 16 is pivoted from the transport position to an operative or working position, with bracket 20 pivoting with handle 16 until the free end of screw 30 abuts with lever 26 and bracket 20 is pivotally spaced from lever 26. As lever 26 pivots from the transport position, vacuum shoe 38 moves vertically upward from the lowermost, transport position to a working position such that brush 88 engages the floor surface. It should then be noted that the majority of the mass of apparatus 10 is supported upon the floor surface at one end by wheels 14 and at the other end by vacuum shoe 38. The height of brush 88 relative to the floor surface and thus the amount of support of apparatus 10 provided by brush 88 in its working position and thus the downward pressure of brush 88 on the floor surface can then be adjusted by threading screw 30 inward or outward which moves the lower edge of vacuum shoe 38 to differing spacing from chassis 18.

When it is desired for apparatus 10 to be utilized to clean hard floor surfaces such as tile, cement, or hardwood, hose 90 can be removed from vacuum shoe 38 and vacuum shoe 38 can be removed from apparatus 10 by sliding pivot pin 40 from sleeve 34 by suitable manipulation of provisions 42. Squeegee assembly 56 can then be installed on apparatus 10 by sliding slide plates 62 into slide tracks 60. Hose 90 can then be attached to squeegee 58 and the valve in the solution delivery line can be positioned at the flow rate for hard floor surfaces. Further, carriage assembly 68 can then be installed on apparatus 10 by sliding slide plate 72 into slide track 70, with follower pin 82 extending into slot 54. It should be noted that provisions 74 are suitably manipulated allowing slide plate 72 to be slid in slide track 70 and be held in the attached position. Brush 88 can be removed and replaced with one for use in cleaning hard floor surfaces such as tile, cement, or hardwood if desired or necessary. In the transport and storage position of handle 16, bracket 20 will pivot lever 26 about axis 28 such that roller 86 is in a lowermost position due to the interconnection of lever 44 and linkage 46. Apparatus 10 can be supported on the floor surface by wheels 14 and roller 86 with brush 88 and preferably also squeegee 58 at a height spaced from the floor surface to prevent deformation thereof which may occur if left in contact with the floor surface during long periods of nonuse. When it is desired to clean the floor surface, handle 16 is pivoted from the transport position to an operative or working position, with bracket 20 pivoting with handle 16 until the free end of screw 30 abuts with lever 26 and bracket 20 is pivotally spaced from lever 26. As lever 26 pivots from the transport position, roller 86 moves vertically upward from the lowermost, storage position to a working position, such that brush 88 and squeegee 58 engages the floor surface. Wheels 14 and roller 86 provide rolling support and maneuverability in the working and transport modes. It should then be noted that the majority of the mass of apparatus 10 is supported upon the floor surface at one end by wheels 14 and at the other end by roller 86. The height of brush 88 relative to the floor surface and thus the amount of support of apparatus 10 provided by brush 88 in its working position and thus the downward pressure of brush 88 on the floor surface can be adjusted by threading screw 30 inward or outward which moves roller 86 to differing spacing from chassis 18. Although engaging the floor surface, squeegee 58 provides minimal support due to the mounting by parallelogram linkage 64, with the downward pressure of squeegee 58 being dependent upon the mass of squeegee 58 and/or the biasing provided by parallelogram linkage 64.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Apparatus for cleaning both hard and soft floor surfaces comprising, in combination: a chassis having a first end and a second end; means for movably supporting the first end of the chassis on the floor surface; a brush adjacent to the second end of the chassis for engagement with the floor surface; a vacuum shoe of a generally rigid construction for extraction of solution from soft floor surfaces; means for removably securing the vacuum shoe relative to the chassis adjacent the second end of the chassis; a carriage assembly for movably supporting the second end of the chassis on the floor surface; means for removably securing the carriage assembly to the chassis adjacent the brush; means for moving one of the vacuum shoe and the carriage assembly for supporting the second end of the chassis to change the relative height of the brush from the floor surface, with the chassis being supported on the floor surface by the movably supporting means and one of the vacuum shoe and the carriage assembly when the brush engages the floor surface, with the movably supporting means and the vacuum shoe supporting the chassis when cleaning soft floor surfaces and the movably supporting means and the carriage assembly supporting the chassis when cleaning hard floor surfaces; a squeegee assembly for removing solution from hard floor surfaces; and means for removably securing the squeegee assembly to the second end of the chassis for engaging the squeegee assembly with the floor surface when the chassis is supported on the floor surface by the movably supporting means and the carriage assembly, with the squeegee assembly providing minimal support to the chassis when the squeegee assembly engages the floor surface and removes solution from the floor surface.

2. The hard and soft floor surface cleaning apparatus of claim 1 wherein the moving means changes the relative height of the brush from the floor surface between a transport position with the brush being spaced from the floor surface and a working position with the brush operatively engaging the floor surface.

3. The hard and soft floor surface cleaning apparatus of claim 2 wherein the squeegee assembly is spaced from the floor surface in the transport position.

4. The hard and soft floor surface cleaning apparatus of claim 2 wherein the moving means comprises, in combination: a spindle rotatable about a spindle axis; a first arm for attaching the vacuum shoe removably securing means to the spindle for moving the vacuum shoe when the spindle is rotated; a second arm connected to the spindle and operatively connected to the carriage assembly for moving the carriage assembly when the spindle is rotated; and means for rotating the spindle about the spindle axis.

5. The hard and soft floor surface cleaning apparatus of claim 4 wherein the rotating means comprises, in combination: a first lever secured to the spindle; a second lever pivotally mounted to the chassis about a lever axis spaced from and parallel to the spindle axis; and a linkage having a first end pivotally mounted to the first lever spaced from the spindle axis and a second end pivotally mounted to the second lever spaced from the lever axis; and means for pivoting the second lever about the lever axis.

6. The hard and soft floor surface cleaning apparatus of claim 5 wherein the pivoting means comprises a pin mounted in the chassis for axial movement and having a free end for abutting with the second lever spaced from the lever axis.

7. The hard and soft floor surface cleaning apparatus of claim 6 further comprising, in combination: a handle pivotable about a handle axis spaced from and parallel to the spindle axis between a transport position and a working position; and wherein the pivoting means further comprises, in combination: a bracket pivotable with the handle for abutting with the second lever when the handle is in the transport position and being spaced from the second lever when the handle is in the working position, with the free end of the pin being spaced from the second lever when the handle is in the transport position.

8. The hard and soft floor surface cleaning apparatus of claim 7 wherein the carriage assembly comprises, in combination: a roller; and means for mounting the roller for movement at differing spacing from the chassis when secured to the chassis by the carriage assembly removably securing means and operatively connected to the second arm.

9. The hard and soft floor surface cleaning apparatus of claim 8 wherein the roller mounting means comprises, in combination: a pivot shaft rotatable about a shaft axis; a crank arm secured to the pivot shaft; and means for removably operatively connecting the crank arm to the second arm.

10. The hard and soft floor surface cleaning apparatus of claim 9 wherein the removably operatively connecting means comprises, in combination: an elongated slot formed in the second arm; and a follower pin mounted to the crank arm for slideable receipt in the elongated slot.

11. The hard and soft floor surface cleaning apparatus of claim 10 wherein the roller mounting means further comprises, in combination: mounting tabs secured to the pivot shaft; and means for rotatably mounting the roller to the mounting tabs about an axis parallel to the pivot shaft.

12. The hard and soft floor surface cleaning apparatus of claim 11 wherein the carriage assembly removably securing means comprises, in combination: a slide track secured to the chassis; and a slide plate slideably received in the slide track in a slide direction, with the pivot shaft rotatably secured to the slide plate generally parallel to the slide direction.

13. The hard and soft floor surface cleaning apparatus of claim 12 wherein the carriage assembly removably securing means further comprises, in combination: a plunger pin carried by the slide plate for removable receipt in an aperture formed in the slide track.

14. Apparatus for cleaning both hard and soft floor surfaces comprising, in combination: a chassis having a first end and a second end; means for movably supporting the first end of the chassis on the floor surface; a brush adjacent to the second end of the chassis for engagement with the floor surface; a vacuum shoe of a generally rigid construction for extraction of solution from soft floor surfaces; means for removably securing the vacuum shoe relative to the chassis adjacent the second end of the chassis; a carriage assembly for movably supporting the second end of the chassis on the floor surface; means for removably securing the carriage assembly to the chassis adjacent the brush; means for moving one of the vacuum shoe and the carriage assembly for supporting the second end of the chassis to change the relative height of the brush from the floor surface; a squeegee assembly for removing solution from hard floor surfaces; and means for removably securing the squeegee assembly to the second end of the chassis; wherein the squeegee assembly removably securing means comprises, in combination: at least a first slide track secured to the chassis; and a slide plate slideably received in the slide track; and wherein the squeegee assembly comprises, in combination: a squeegee; and means for securing the squeegee to the slide plate for movement in a direction perpendicular to the floor surface.

15. Apparatus for cleaning both hard and soft floor surfaces comprising, in combination: a chassis having a first end and a second end; means for movably supporting the first end of the chassis on the floor surface; a brush adjacent to the second end of the chassis for engagement with the floor surface; a vacuum shoe of a generally rigid construction for extraction of solution from soft floor surfaces; means for removably securing the vacuum shoe relative to the chassis adjacent the second end of the chassis; a carriage assembly for movably supporting the second end of the chassis on the floor surface; means for removably securing the carriage assembly to the chassis adjacent the brush; means for moving one of the vacuum shoe and the carriage assembly for supporting the second end of the chassis to change the relative height of the brush from the floor surface; a squeegee assembly for removing solution from hard floor surfaces; and means for removably securing the squeegee assembly to the second end of the chassis; wherein the vacuum shoe removably securing means comprises, in combination: a sleeve; and a pivot pin secured to the vacuum shoe and axially slideably received and rotatable in the sleeve.

16. Apparatus for cleaning both hard and soft floor surfaces comprising, in combination: a chassis having a first end and a second end; means for movably supporting the first end of the chassis on the floor surface; a brush adjacent to the second end of the chassis for engagement with the floor surface; a vacuum shoe of a generally rigid construction for extraction of solution from soft floor surfaces; means for removably securing the vacuum shoe relative to the chassis adjacent the second end of the chassis; a carriage assembly for movably supporting the second end of the chassis on the floor surface; means for removably securing the carriage assembly to the chassis adjacent the brush; means for moving one of the vacuum shoe and the carriage assembly for supporting the second end of the chassis to change the relative height of the brush from the floor surface; a squeegee assembly for removing solution from hard floor surfaces; and means for removably securing the squeegee assembly to the second end of the chassis; wherein the moving means comprises, in combination: a spindle rotatable about a spindle axis; a first arm for attaching the vacuum shoe removably securing means to the spindle for moving the vacuum shoe when the spindle is rotated; a second arm connected to the spindle and operatively connected to the carriage assembly for moving the carriage assembly when the spindle is rotated; and means for rotating the spindle about the spindle axis.

17. The hard and soft floor surface cleaning apparatus of claim 16 wherein the rotating means comprises, in combination: a first lever secured to the spindle; a second lever pivotally mounted to the chassis about a lever axis spaced from and parallel to the spindle axis; and a linkage having a first end pivotally mounted to the first lever spaced from the spindle axis and a second end pivotally mounted to the second lever spaced from the lever axis; and means for pivoting the second lever about the lever axis.

18. The hard and soft floor surface cleaning apparatus of claim 16 wherein the carriage assembly comprises, in combination: a roller; and means for mounting the roller for movement at differing spacing from the chassis when secured to the chassis by the carriage assembly removably securing means and operatively connected to the second arm.

19. The hard and soft floor surface cleaning apparatus of claim 18 wherein the roller mounting means comprises, in combination: a pivot shaft rotatable about a shaft axis; a crank arm secured to the pivot shaft; and means for removably operatively connecting the crank arm to the second arm.

20. Apparatus for cleaning both hard and soft floor surfaces comprising, in combination: a chassis having a first end and a second end; means for movably supporting the first end of the chassis on the floor surface; a brush adjacent to the second end of the chassis for engagement with the floor surface; a vacuum shoe of a generally rigid construction for extraction of solution from soft floor surfaces; means for removably securing the vacuum shoe relative to the chassis adjacent the second end of the chassis; a carriage assembly for movably supporting the second end of the chassis on the floor surface; means for removably securing the carriage assembly to the chassis adjacent the brush; means for moving one of the vacuum shoe and the carriage assembly for supporting the second end of the chassis to change the relative height of the brush from the floor surface; a squeegee assembly for removing solution from hard floor surfaces; means for removably securing the squeegee assembly to the second end of the chassis; a handle pivotable about a handle axis between a transport position and a working position; and a bracket pivotable with the handle and operatively connected to the moving means when the handle is in the transport position to space the brush from the floor surface and being operatively spaced from the moving means when the handle is in the working position, with the brush engaging the floor surface when the handle is in the working position.

21. The apparatus of claim 1 wherein the removably securing means allows the carriage assembly and the squeegee assembly to be secured to the chassis and the vacuum shoe to be removed from the chassis when cleaning hard floor surfaces and allowing the vacuum shoe to be secured to the chassis and the carriage assembly and the squeegee assembly to be removed from the chassis when cleaning soft floor surfaces; and wherein the removably securing means allow ease of transformation and conversion for cleaning hard and soft floor surfaces.

* * * * *